United States Patent [19]

Berkovitz

[11] 4,105,864

[45] Aug. 8, 1978

[54] STEREO AND SPACIOUSNESS REVERBERATION SYSTEM USING RANDOM ACCESS MEMORY AND MULTIPLEX

[75] Inventor: Robert A. Berkovitz, Lexington, Mass.

[73] Assignee: Teledyne Industries, Inc., Los Angeles, Calif.

[21] Appl. No.: 706,011

[22] Filed: Jul. 16, 1976

[30] Foreign Application Priority Data

Jul. 17, 1975 [GB] United Kingdom ..... 30009/75
Sep. 4, 1975 [GB] United Kingdom ..... 36442/75

[51] Int. Cl.[2] ..... H04R 5/00
[52] U.S. Cl. ..... 179/1 J; 179/1 G
[58] Field of Search ..... 179/1 J, 1 G, 1 GQ, 179/15 BT, 15 BV, 1 AT, 15.55 T, 15.55 R, 1 GP

[56] References Cited

U.S. PATENT DOCUMENTS

| | | | |
|---|---|---|---|
| 3,154,644 | 10/1964 | Tak | 179/1 J |
| 3,484,563 | 12/1969 | Tak | 179/1 J |
| 3,492,425 | 1/1970 | Evans | 179/1 J |
| 3,681,531 | 8/1972 | Burkhard | 179/1 J |
| 3,710,034 | 1/1973 | Murray | 179/1 G |
| 3,816,664 | 6/1974 | Koch | 179/15.55 T |
| 3,928,722 | 12/1975 | Nakata | 179/1 SM |
| 3,934,094 | 1/1976 | Kobayashi | 179/15.55 T |
| 3,949,175 | 4/1976 | Tanizoe | 179/15.55 T |
| 4,027,101 | 5/1977 | De Fretas et al. | 179/1 G |

FOREIGN PATENT DOCUMENTS

| | | | |
|---|---|---|---|
| 1,149,394 | 10/1961 | Fed. Rep. of Germany | 179/1 G |

*Primary Examiner*—Thomas W. Brown
*Assistant Examiner*—E. S. Kemeny
*Attorney, Agent, or Firm*—Shoemaker and Mattare, Ltd.

[57] ABSTRACT

A sound reproduction arrangement and audio signal delay apparatus suitable for use in such an arrangement, includes, in a listening area, one or more primary sound sources for mono- or multichannel reproduction respectively, and a plurality of secondary sources spaced around the perimeter of the listening area and each providing an acoustic signal corresponding to that from the primary source or sources delayed by a respective and independently selectable delay constant and attenuated by a respective and independently selectable gain constant. Control apparatus is connected with the sound sources to derive a plurality of signals for the respective sound sources from an input signal. The delay constants are substantially greater than the time taken for sound to traverse the listening area, so that the sound from the secondary sources simulates reverberation or reflected sound, and a listener has a sensation of spaciousness normally associated with an enclosure which is larger than the listening area, such as a concert hall, for example. Features of the invention include a random-access memory which stores time-multiplexed data representing sampled input audio and channel-control information.

14 Claims, 5 Drawing Figures t-3
W
t
t-10
t-8

OUTPUT LINES
91
88
87
SEPARATED DELAY SIGNAL LINE
DMUX
85
D/A
83
MULTIPLE OUTPUT LINE
37
RAM
29
ADDRESS INPUT LINES
35
SR
55
42
43
41
40
57
V
81
73
77
71
75
79
DECIMAL TO BINARY
COUNTER
63
59
69
67
MV
65
61
13
11
CLOCK
÷4
15
17
WRITE-ENABLE INPUT
31
23
A/D
21
25
27
DATA INPUT
19
SIGNAL INPUT LINE

STEREO AND SPACIOUSNESS REVERBERATION SYSTEM USING RANDOM ACCESS MEMORY AND MULTIPLEX

BACKGROUND OF THE INVENTION

This invention relates to a sound reproduction arrangement, and to audio signal delay apparatus particularly, but not exclusively, suitable for use in such an arrangement.

When a sound from a primary source is repeated at intervals from other sources which are displaced in azimuth from the primary source, a listener can have the sensation of being in an enclosed space, the reason being that an enclosed space produces reflections similarly delayed and displaced with respect to the direct sound. The character of the sensation, and the apparent size and shape of the space, depend upon the delay intervals for the respective repetitions, the relative intensities of the repetitions, and the directions from which the repetitions approach the listener. It is this effect which produces the sensation of spaciousness noticed by listeners in a concert hall, but which is lacking when, for example, recorded music is reproduced in a domestic living room. The effect can be described loosely as "reverberation," although as will appear below the term "reverberation" is used herein, and in the art generally, in a somewhat more restricted and speciallized sense.

The pattern of reflections in a concert hall can be considered to have two aspects: the early reflection pattern formed by low-order reflections arriving at a listener within a time period, for an average size concert hall, of the order of 100 msec. following arrival of the direct sound; and the "reverberation" pattern comprising large numbers of temporally closely spaced reflections arriving during a period following the early reflections. In most concert halls, the density and randomness or incoherence of reflections in the reverberation pattern is sufficient to resemble band-limited noise with spectral characteristics similar to those of the original sound, but without distinct time- or direction-ordered components. This noise-like reverberation decays generally exponentially at a rate depending upon the physical properties of the hall, those properties often being regarded as the primary acoustic properties of the hall.

In the art, many attempts have been made to artificially reproduce with, for example, recorded music, the sensation of listening to the music in a large enclosure such as a concert hall. Arrangements using various forms of delay device, particularly recirculating delay devices, have been used extensively to mix the primary sound with delayed repetitions of that sound, but in general such arrangements have been successful only in simulating the reverberant aspect of a reflection pattern. Whilst with the use of such arrangements the tonal quality of the reproduced sound seems to correspond reasonably closely with that which would be experienced in a concert hall, the sensation of spaciousness associated with a concert hall is seldom apparent.

It is believed that the production and character of the sensation of spaciousness is critically dependent upon the delay, direction and relative intensity of each of the early reflections heard (although usually not consciously perceived) by the listener. It follows, therefore, that to produce a sensation of spaciousness multiple repetitions should be provided each with an appropriately and individually selected time delay, direction and intensity.

It will be appreciated that audio signal delay apparatus suitable for generating the delayed signals in an arrangement for reproducing the early reflection pattern as described above should preferably be capable of producing a relatively large number, for example ten or more, delayed signals corresponding to a primary input signal. Moreover, the delay constant for each of the delayed signals should be selectable independently of that selected for each of the other delayed signals, should preferably be selectable from within a range of from a few tens of milliseconds to several hundred milliseconds, and should preferably be capable of a relatively fine degree of incremental adjustment, for example, in steps of the order of 1 millisecond or less.

DESCRIPTION OF THE PRIOR ART

U.S. Pat. No. 3,681,531 (Burkhard et al.) discloses a digital delay system for audio signal processing intended primarily for use in sound reinforcement systems. (It will be noted, in connection with sound reinforcement systems, that the delays required are of the same order, or are rather less than, the time taken for sound to traverse the listening area). The apparatus described is based on the use of a shift register (or a functionally similar digital data store) provided with fixed tapping points along its length. The delayed signals are obtained from the taps, the delay constant required for any particular delayed signal being selected by appropriate selection of the tapping point for that signal. A severe disadvantage with the use of a shift register to provide the delays in an arrangement intended to reproduce early reflection patterns is that the number of available delays is limited. It will be appreciated that if each delay is to be selectable from a range extending from substantially zero to several hundred milliseconds in steps of about 1 millisecond, several hundred tapping points would be required on the shift register. Moreover, the means for selecting the appropriate tapping points for each of the many delay signals required would prove extremely complex. By way of illustration, U.S. Pat. No. 3,736,514 (Francis F. Lee) describes a shift register-based audio signal delay apparatus (described in relation to application for sound reinforcement) said to be capable of producing up to five delayed signals each having a delay of up to 320 msecs. in steps of 5 msecs. As will appear from the specification, to achieve this degree of selectivity for the delay constants for each delayed signal required a complex multiplexing arrangement for the outputs from each of 64 tapping points on the shift register.

SUMMARY OF THE INVENTION

It is an object of the present invention to provide a sound reproduction arrangement for producing, in a listening area, an early reflection pattern similar to that which would be produced by an enclosure of substantially greater size than that of the listening area.

It is a more specific object of the present invention to provide a sound reproduction arrangement for producing in a listening area, a plurality of repetitions of a sound from different respective directions the time delay for each of the repetitions being different from that of the other repetitions and substantially greater than the time taken for sound to traverse the listening area.

It is a further object of the present invention to provide audio signal delay apparatus suitable for use in providing the delayed signals in the above-mentioned sound reproduction arrangement.

It is a further more specific object of the present invention to provide relatively uncomplicated and adaptable audio signal delay apparatus for providing a plurality of delayed signals each of which can have a delay constant independently selected from a wide range of closely spaced values.

From one aspect, the present invention provides a sound reproduction arrangement with at least one primary loudspeaker located in a listening area and connected to be driven by an input audio frequency signal, signal delay means responsive to the input audio signal to provide a plurality of delayed signals delayed by respective delay constants which are large compared with the time taken for sound to traverse the listening area or which can be individually selected from a range of values which are large compared with the time taken for sound to traverse the listening area, and a plurality of secondary loudspeakers spaced around the perimeter of the listening area and connected to be driven in response to the delayed signals or respective delayed signals.

From another aspect, the invention provides audio signal delay apparatus comprising random access data storage means for storing successive sampled values of an input audio signal, and control means arranged to supply a preselectable sequence of address instructions to the data storage means so as to produce successive cycles of record/recall operations. In each such cycle, at least one of the successive sampled values is recorded and a plurality of stored values, which stored values are being sampled values which have each been recorded a respective preselectable number of cycles previously, are recalled sequentially. The apparatus further comprises demultiplexer means for assigning the recalled values to corresponding output channels. Thus, in use, the data output from the storage means comprises a plurality of time division multiplexed components. Each component is associated with a respective one of the pre-selectable numbers and each comprises the successively sampled values of the input signal delayed by a period related to that number. The delayed signals thus formed by the components are supplied to corresponding output channels.

DESCRIPTION OF ILLUSTRATED EMBODIMENTS

Further features, advantages and objects of the invention will appear from the following description of embodiments thereof, described by way of example only with reference to the accompanying drawings wherein:

FIG. 1 is a schematic illustration of audio signal delay apparatus in accordance with the invention;

FIG. 1*a* shows timing between recorded and recalled information;

Figures 1, 1A:
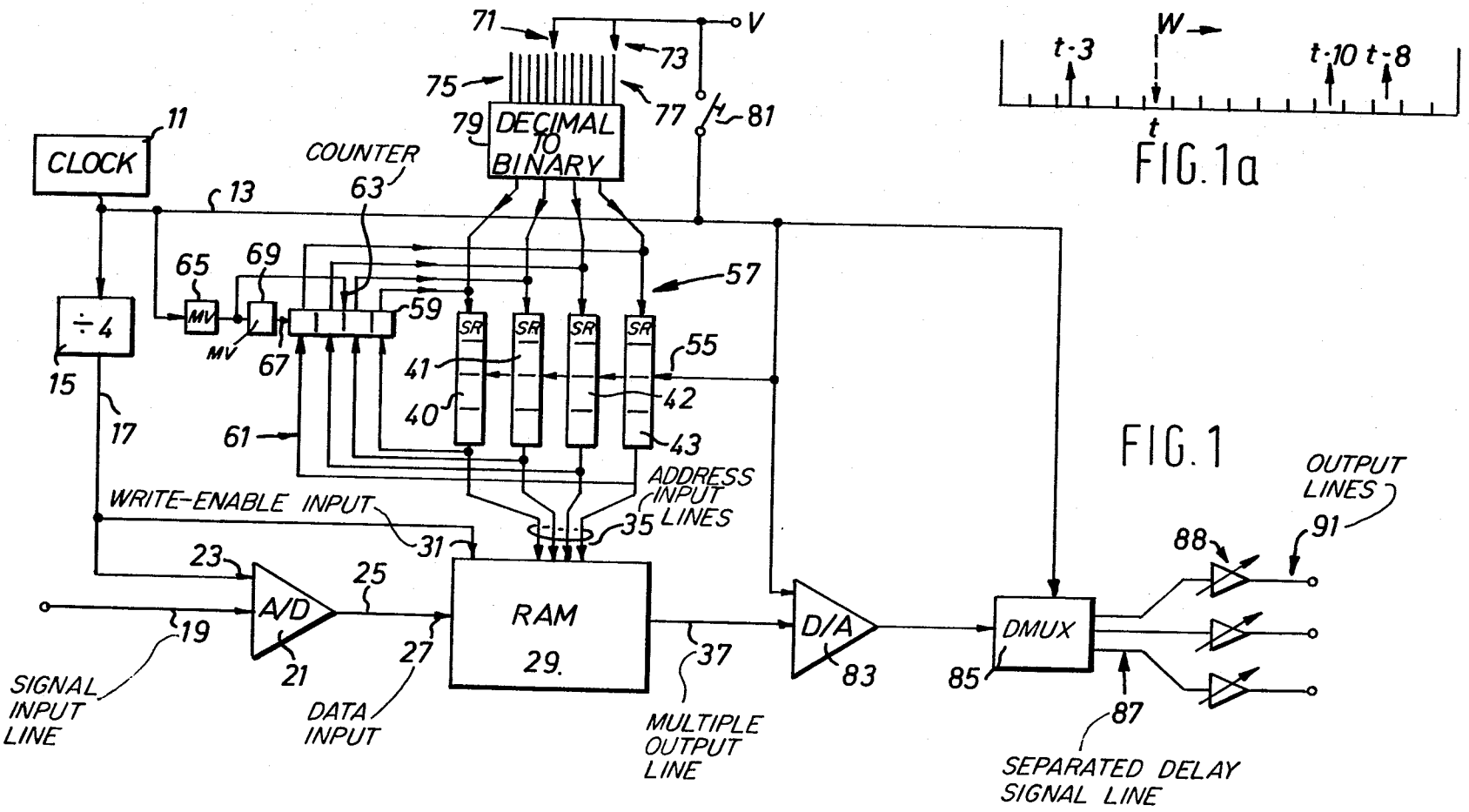

FIG. 1 illustrates signal delay apparatus comprising a random access memory (RAM) connected to receive successive values of a digital input signal and address means connected with the address input lines of the RAM for registering several address words which can be selected from a series of address words representing respective storage locations in the RAM, the address means being responsive to a periodic clock signal to apply the registered words in rotation to said address lines and update each registered word by one step in said series between each successive application of the registered word to the address lines, and the RAM being connected to record data received thereby when addressed by one of the registered words and to recall data recorded therein when addressed by the others of the registered words so that, in operation, the data output from the RAM forms a time division multiplex signal comprising a plurality of components associated respectively with said others of said registered words and each comprising a sequence of the successive values of the input signal delayed by a period related to the number of steps in said series by which the associated registered word differs from the said one of said registered words.

The address means comprises a parallel bank of shift registers for registering the address words in respective arrays of corresponding stages of the shift registers. The output stages of the shift registers are connected respectively with the address lines of the RAM, so that in response to the clock pulses the registered words are stepped progressively towards the output stages and applied in turn to the address lines. The address means further comprises updating means connected with the output stages of the shift registers to receive each registered word in turn and apply a corresponding updated word to the inputs of the registers. The registered words are thus recycled through the shift registers in response to the clock pulses so as to be applied in rotation to the RAM address lines and updated on each cycle.

The digital multiplex signal output from the RAM is applied to the input of a digital-to-analogue (D/A) converter for conversion into a corresponding analogue multiplex signal, and this is de-multiplexed by a de-multiplexer connected for operation in synchronism with the clock pulses so as to separate the components of the multiplex signal into a corresponding plurality of separate delay signals. The delay signals are multiplied by respective selectable gain coefficients by passing the signals through respective variable gain amplifier/attenuator circuits.

Programming means are provided for loading a selected combination of address words into the shift registers in preparation for operation of the apparatus. The programming means is arranged to enable each selected word to be applied in turn to the input lines of the shift registers, and to enable a shift pulse to be applied to the registers during each such application of an address word.

Referring to FIG. 1 in more detail, the apparatus comprises a clock 11 producing on line 13 a series of clock pulses with a repetition frequency $n.f$ where $n$ is the required number of delayed output signals plus 1 and $f$ is the sample frequency. The number of delayed signals is taken as 3 for the purposes of the present illustration, giving a value for $n$ of 4, but it will be appreciated that the principle of operation remains the same whatever the number of delayed signals, and in practice the number of delayed signals could be of the order of sixteen or more. The clock pulses on line 13 are supplied to a modulo-$n$ counter 15 to produce on line 17 a series of sample pulses at sample frequency $f$.

The analogue input signal to the system is applied on the signal input line 19 of analogue-to-digital (A/D) converter 21. In response to successive sample pulses applied to the clock input 23 of the converter, the converter samples the analogue signal and presents on output line 25 a parallel-bit digital signal comprising a succession of binary words representing the successively sampled values. It will be appreciated that in accordance with established sampling theory $f$ should be at least double the maximum frequency component of the analogue signal.

The successive binary sample words from converter 21 are applied to the data input 27 of the RAM 29. In response to a sample pulse forming a WRITE command on write-enable input 31 the sample word presented to input 27 at that moment is recorded at the one of a plurality of locations in the memory represented by the binary word on the address input lines 35. In response to a READ command on write-enable input 31 the sampled word recorded at the location represented by the binary word on address input lines 35 is presented on multiple output line 37.

In practice, the number of storage locations in the RAM 29 would be of the order of several thousand or more, but for the purpose of the present illustration a RAM with 16 storage locations is shown. The sixteen corresponding addresses can therefore be represented by different combinations of four binary digits, and the address words therefore comprise four bits each. The address means thus requires four parallel shift registers to accommodate the address words in parallel-bit array. The shift registers comprise $n$ stages where $n = 4$ as defined above. The four four-stage shift registers are indicated in the drawing at 40, 41, 42 and 43 respectively. In the drawing, the uppermost stages of the shift registers are the input stages and the lowest stages are the output stages.

The updating means of the address means comprises a parallel-in/parallel-out four bit counter 59 with parallel input lines 61 connected with the output stages of the shift registers 40 to 43 and parallel-bit outputs connected respectively with the shift register input lines 57. A shift input 63 of the counter 59 is connected with the output of astable multivibrator 65 which responds to a clock pulse to provide a delayed output pulse. A count input 67 is connected to the output of astable multivibrator 69 which produces a further delayed pulse in response to an output pulse from the multivibrator 65. The combined delay of circuits 65 and 69 is a fraction of the clock repetition period so that a shift pulse and a count pulse are supplied to the counter during the period between consecutive clock pulses.

The programming means comprises a ten-way switch 71 and a two-way switch 73 which can be set to represent in decimal code the units and tens digits respectively of a selected address word. Since, in the illustrated example, the number of addresses from which these selections can be made is only 16, provision need only be made, of course, for selection of a ZERO or ONE for the tens digit. The decimal coded address information, represented by the one of the ten "units" lines 75 and the one of the two "tens" lines 77 connected by the switches with a reference voltage $v$ on line 76, is converted to binary code in converter 79 for presentation on the input lines 57 of the shift registers. A push button 81 is connected between line 76 and clock pulse line 13 for manual operation to apply a pulse to shift input 55, thereby to shift the selected address word into the first stages of the registers.

To prepare the apparatus for operation, switches 71 and 73 are set to represent the first address word to be loaded, and that word is strobed into the first stage of the shift registers by depressing push button 81. This operation is repeated for each of the other three address words, each new word being shifted into the first stage of the registers and the earlier words being shifted down by one stage in response to a pulse on line 13 applied by push button 81.

As described previously, in response to a pulse on line 13, multivibrators 65 and 69 apply a delayed pulse to shift input 63 followed by a further delayed pulse to count input 67 of counter 59. Thus, shortly after the manually applied pulse on line 13 which shifts the last of the address words into the registers, the first address word, which when occupies the output stage, is entered also into counter 59 and has a count of ONE added.

Finally, the output lines from decimal-to-binary converter 79 are isolated from the register input lines 57 by means of switches (not shown). The apparatus is then ready for operation, with four address words accommodated in respective stages of the shift registers, and an updated version of the first address word applied to the input lines 57 of the registers by the counter 59.

In operation, the registered words are stepped downwardly through the shift registers in response to the clock pulses, and recycled via the counter 59. The registered words are thus applied in rotation to the address lines 35 of the RAM 29, and updated by one count on each cycle. Over 16 successive cycles, therefore, the entire contents of the RAM are scanned by each registered word.

A READ-command is applied to the write-enable input of the RAM on application of three of the registered words to the address lines, and a WRITE-command is applied on every fourth application of a registered word. Thus, data is recorded in the RAM on application of just one of the registered words, which can conveniently be referred to as the "write" word, and data is recalled from the RAM on application of each of the other three registered words, referred to as "read" words. When the write word is applied to the RAM, a sampled value of the analogue input signal on line 19 is recorded at the corresponding location in the RAM. When a read word is applied, a previously recorded value of the input signal is recalled from the corresponding location in the RAM.

FIG. 1*a* illustrates schematically the relation between recorded and recalled information. The write word is shown as having a value $t$, and is indicated by the letter W and a dashed-arrow. On four successive clock pulses, a value is recorded at the location represented by address $t$, and values are recalled sequentially from locations represented by read words $t$-3, $t$-8 and $t$-10. On the next clock pulse, the location corresponding to the address just to the right of the dashed arrow receives new information, and on the following clock pulses information is recalled from the locations represented by addresses just to the right of the read words indicated in the drawing.

It will be appreciated, therefore, that the data output from the RAM forms a time division multiplex signal comprising three components each associated with a respective one of the read words and comprising a sequence of the successive values of the input signal delayed by a period related to the number of counts by which the associated read word differs from the write word. It will also be appreciated that since each registered word is updated by the same count of ONE during each cycle, the differences between the registered words remain constant during operation of the apparatus. Thus, the delay times for each of the component delay signals can be selected, when preparing the apparatus for operation, by choosing an appropriate combination of address words for loading into the registers.

The D/A converter and de-multiplexer for separating the component delay signals in the data output from the RAM are indicated at 83 and 85 respectively. The separated delay signals are supplied on lines 87 to respective amplifier/attenuator circuits 88 so that the output delay signals presented on output lines 91 can each be amplified and/or attenuated by a respective gain coefficient of selectable magnitude.

Figure 2:
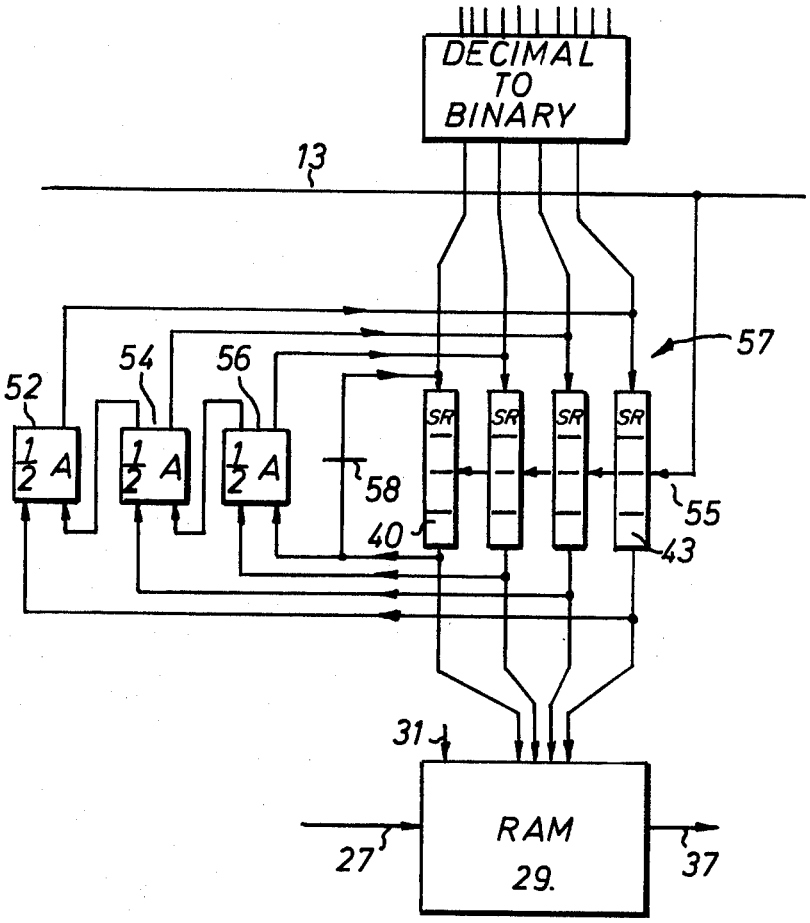
FIG. 2 is a schematic illustration of a modification of part of the apparatus of FIG. 1.

FIG. 2 illustrates an alternative form of address means for use in the apparatus of FIG. 1. The counter 59 of FIG. 1 is replaced by three half-adder circuits 52, 54 and 56 and an inverter 58 connected as shown. The registered words are recycled through the adder network. The effect of the adder network is to re-code the binary information so that the binary word presented on input lines 57 of the shift registers is a count of ONE in excess of the binary word in the output stage of the shift registers. Thus, a count of ONE is added to each address word as it is recycled.

Figure 3:
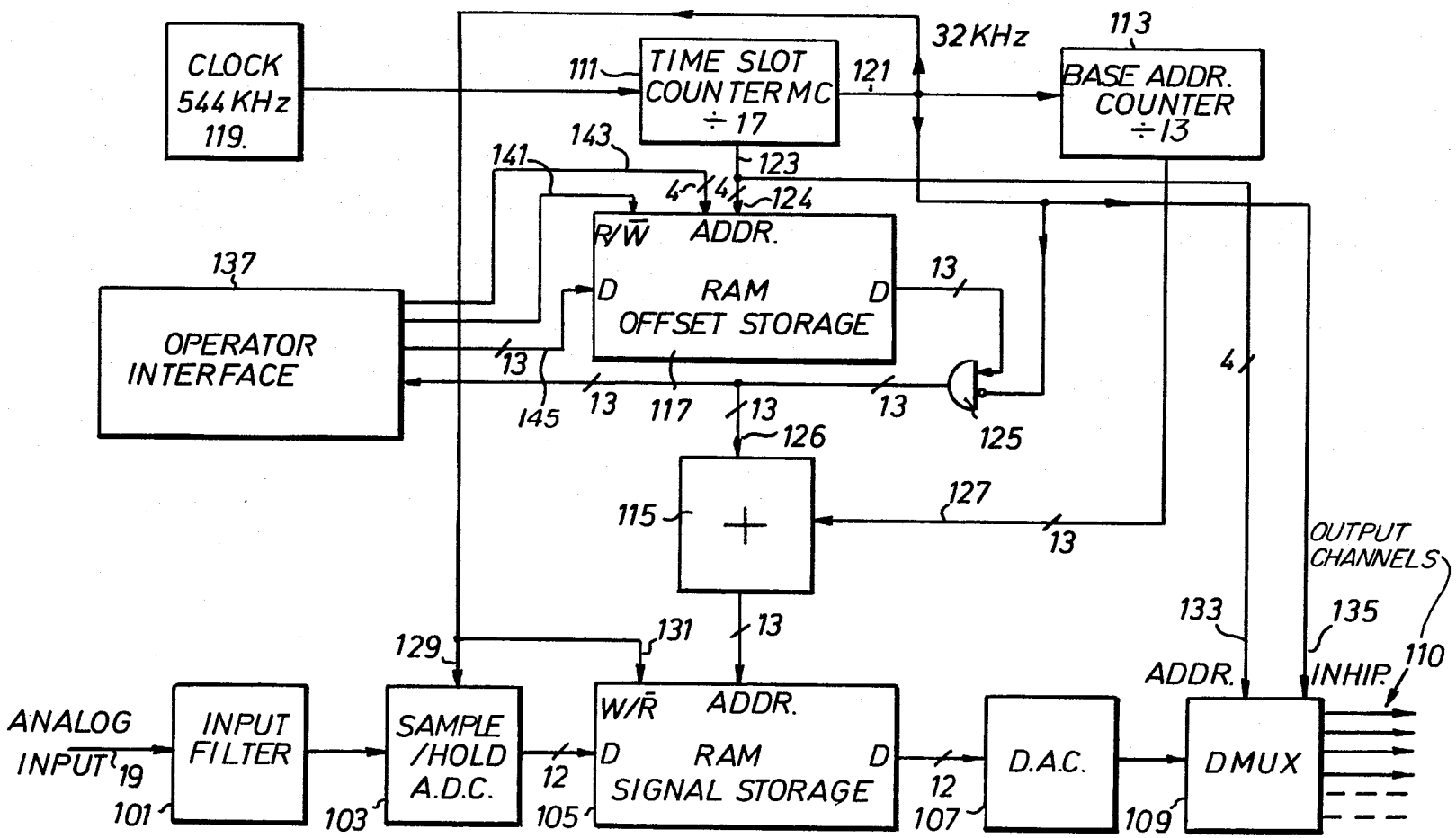
FIG. 3 is a schematic illustration of a further embodiment of audio signal delay apparatus in accordance with the invention.

FIG. 3 is a schematic illustration of a practical embodiment of audio signal delay apparatus in accordance with the invention. The apparatus of FIG. 3 is capable of providing 16 independent delayed signals at a sample rate of 32 KHz and with delay constants of up to 256 msec.

The signal channel for the audio signal data in the apparatus of FIG. 3 is similar to that of the example illustrated in FIG. 1. The signal channel comprises a low-pass input filter 101 intended to limit the bandwidth of the input signal to less than half the sample frequency, sample/hold and analog-to-digital conversion circuit 103, signal storage RAM 105, digital-to-analog converter 107, and de-multiplexer 109. The signal storage RAM 105 is formed by an 8192 word by 12-bit array of 96 1024-bit random-access memory integrated circuits. Each of the output channels 110 from the de-multiplexer 109 is provided with a low-pass output filter (not shown) and adjustable attenuator (not shown).

In operation, sampled signal values are recorded and recalled from the signal storage 105 in a similar manner to that described above with reference to FIG. 1, a sample value being recorded in the RAM on every seventeenth clock pulse and sample values for the respective delayed signals being recalled sequentially on the intermediate clock pulses.

The address means comprises a modulo-17 time slot counter 111, a 13-bit base address counter 113, an arithmetic unit 115 and a 256-word by 13-bit random access memory 117. The time slot counter 111 is clocked in response to 544 KHz clock pulses from clock 119 so as to provide a pulse on MAXIMUM COUNT output line 121 on every seventeenth clock pulse, that is to say, at a 32 KHz rate, and to provide a parallel-bit output on lines 123 representing the four least significant bits of the contents of the counter. The output 123 of the time slot counter is supplied to a first four 124 of the address lines of offset storage RAM 117 so that a corresponding 16 locations in the RAM are addressed sequentially as the time slot counter is cycled in response to the clock pulses. The offset data (described more fully below) from those sequentially accessed locations is applied, via normally enabled AND-gates 125, to a first parallel input 126 of arithmetic unit 115. When the time slot counter 111 reaches the maximum count of 16 (taking the minimum count to be zero) the corresponding maximum count signal of output 121 disables the AND-gate 125 and a ZERO is applied to the first input 126 of the arithmetic unit.

The base address counter 113 is clocked in response to the 32 KHz pulses output by the time slot counter, and a parallel-bit output representing the contents of the base address counter is applied to the second input 127 of the arithmetic unit. The output from the arithmetic unit is applied to the address lines of the signal storage RAM 105. The START CONVERSION input 129 of sample/hold and A.D.C. unit 103 and WRITE enable input 131 of signal storage RAM 105 are connected to receive the maximum count signal 121 (in the particular arrangement illustrated it would normally be necessary for the digital output of unit 103 to be held stable until the trailing edge of the signal pulse on line 121).

The address input 133 of de-multiplexer 109 is supplied with the four-bit output 123 of the time slot counter, so that the output channels from the de-multiplexer are addressed sequentially in synchronism with the sequential recall of offset values from RAM 117. The INHIBIT input 135 of de-multiplexer 109 is supplied with the maximum count output 121 from the time slot counter, so that the de-multiplexer outputs are disabled during a WRITE operation in the RAM 105.

In describing the operation of the apparatus of FIG. 3, it is convenient to regard a RECORD/RECALL cycle as beginning with the clock pulse from clock 119 which sets the time slot counter 111 to maximum count. The resulting maximum count signal appearing on line 121 increments the content of base address counter 113 by a count of ONE, disables AND-gate 125, and applies a WRITE command on write-enable input 131 of RAM 105 so that signal data presented thereto by A.D.C. unit 103 (representing the value of the input signal sampled in response to the previous maximum count signal) is recorded in the RAM at the location represented by the content of the base address counter 113. During the next sixteen successive clock pulses, the contents of the time slot counter 111 is stepped progressively from zero through 15 to sequentially recall offset values from RAM 117. During this period, AND-gate 125 is enabled, and the content of base address counter 113 remains constant. The sums of the respective values and the content of the base address counter are applied sequentially to the address input of RAM 105, and stored sampled signal values are recalled from the corresponding locations in the RAM for supply to D.A.C. 107. It will be noted that the sample values recalled from the RAM 105 by this process are those which were recorded a number of RECORD/RECALL cycles previously which is represented by the two's-complement of the corresponding offset value recalled from RAM 117.

An operator interface block 137 provides means for loading the offset values required to provide a selected combination of delay constants (referred to herein as a "program") into RAM 117, and for displaying offset data recalled from that RAM. The interface block includes a keyboard (not shown) for inputting data which can then be transferred to RAM 117 via data input lines 145, a numeric display (not shown) for data recalled from the RAM 117, and program selection means (not shown) for selecting the 16 of the total of 256 locations in the RAM 117 to be accessed, during RECORD-/RECALL cycles, by the slot word counter 111. Up to 16 different programs can be stored in the RAM 117 at any one time. The program selection means of block 137 applies a combination of bits representing the selected program to the second four address lines 143 of the RAM 117.

The interface block 137 also controls read and write operations in the RAM 117. A READ command is applied to the read/write control input 141 of the RAM during normal running of a program and a WRITE command is applied when new offset data is transferred to the RAM on lines 145.

It is believed that a variety of different arrangements suitable for performing the above described functions of the operator interface block will be readily apparent to those skilled in the art, and the present specification would be unnecessarily burdened by a more detailed description of the block.

To simplify the illustration, and facilitate a clear understanding of the principles of operation of the embodiment of FIG. 3, a number of details of implementation have been omitted from the above description. For example, it would be an advantage in practice to provide latches as temporary data stores between many of the functional blocks. In particular, provision of a latch for registering the successive offset values from RAM 117 and presenting those values to input 126 of the arithmetic unit would allow AND-gate 125 to be dispensed with; the latch could be reset to zero during the recording of data in the signal storage RAM 105. However, it is believed that these and other possible refinements and modifications will be readily apparent to those skilled in the art.

It will be appreciated that the delay apparatus described in capable of providing a plurality of delayed signals each having an independantly selectable delay constant. Moreover, in apparatus can be used to provide delayed signals or groups of delayed signals corresponding respectively to several independant input signals. In this case the independant signals would be time division multiplexed in synchronism with the sample frequency, the multiplex signal being applied to the input line 19. The input signals would thus be sampled and recorded in rotation on successive sample pulses, and the de-multiplexer would be controlled to assign the successive recalled values to appropriate sets of output lines appointed for the different channels.

Moreover, the delay constant required for each delayed signal can be independently and conveniently selected by the user with considerable precision and from a wide range limited only by the number of storage locations in the RAM. Furthermore, recovery of the delayed signals in the form of a time division multiplex signal enables all the output signals to be converted to analogue form with a single digital-to-analogue converter.

In the above-described embodiments the signal data is stored in digital form. In alternative embodiments however, random access analog data storage means, bored for example on charge coupled devices, could be used. In this case, of course, the analog-to-digital and digital-to-analog converters would be unnecessary.

Figure 4:
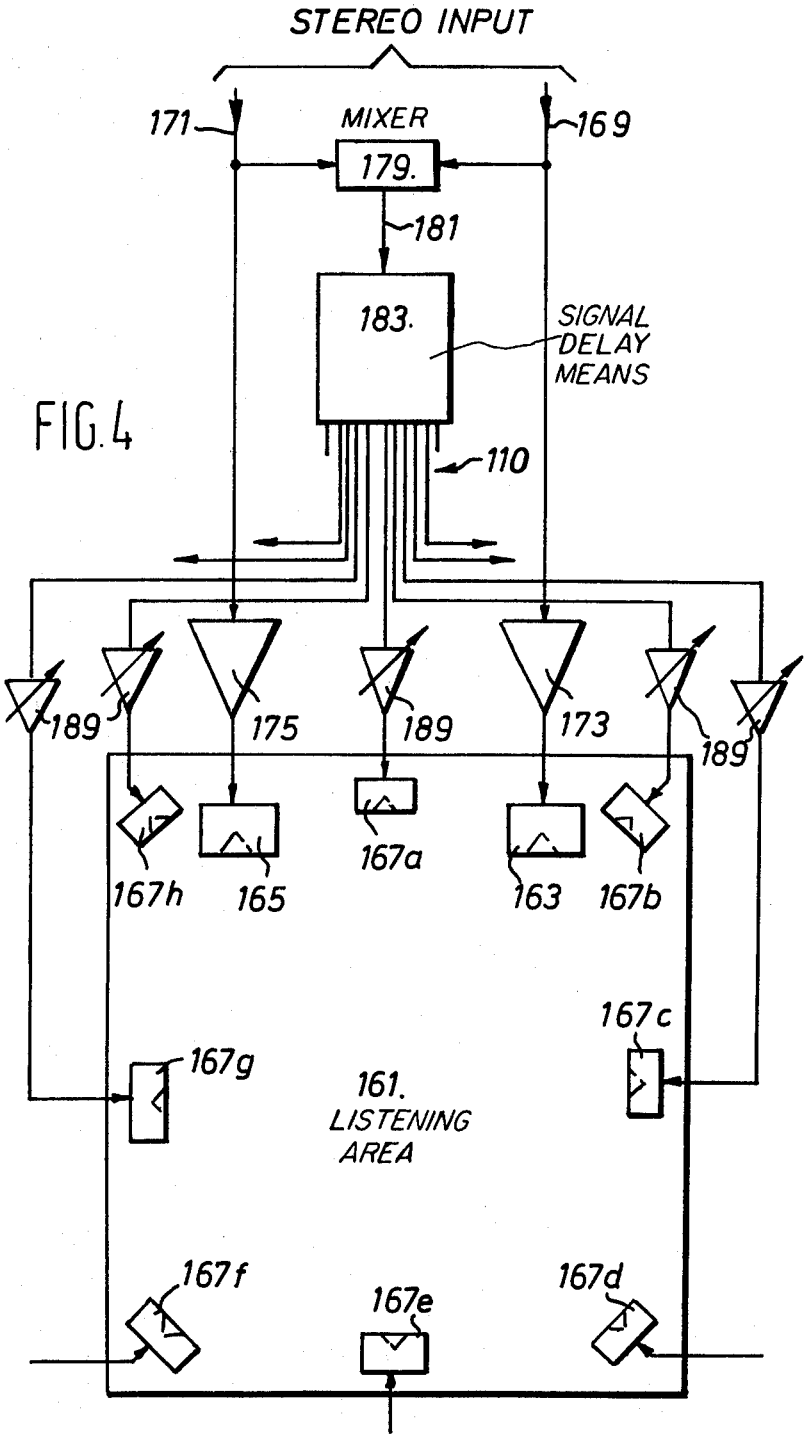
FIG. 4 is a schematic illustration of a sound reproduction arrangement in accordance with the invention.

FIG. 4 illustrates a sound reproduction arrangement in accordance with the invention. The arrangement comprises a listening area 161, first and second primary loudspeakers 163 and 165 located in the listening area and sixteen secondary loudspeakers 167 (only eight shown) spaced around the periphery of the listening area. The 16 secondary loudspeakers are arranged in two banks, those illustrated (167*a* through 167*h*) being disposed in a plane at the same height or slightly below the ear level of a listener, and those (not shown) in the second bank being disposed at corresponding positions in a plane somewhat above the ear level of a listener.

Stereo audio input signals are supplied to the arrangement on input lines 169 and 171, those signals being supplied direct to power amplifiers 173 and 175 driving the respective primary loudspeakers.

Input means 179 is connected to receive both input signals and includes means for mixing the signals to provide, on line 181, signal data representing the summed input signals.

Block 183 represents signal delay means connected to receive the signal data on line 181 to provide 16 delayed signals on respective output lines 110 (not all shown) each corresponding to the input signal data delayed by a respective delay constant. The signal delay means 183, which may for example comprise the signal delay apparatus described with reference to FIG. 3, provides or is capable of providing individually selectable delay constants for the respective delayed signals which are substantially greater than the time taken for sound to traverse the listening area 161.

As shown in the drawing, the delayed signals on lines 110 are supplied to respective ones of the secondary loudspeakers 167 via respective attenuator circuits 189. Each attenuator circuit is provided with separate means for selecting its gain, whereby each of the delayed signals can be multiplied by a respective pre-selectable gain constant.

It will be appreciated that the sound reproduction arrangement illustrated in FIG. 4 is capable of providing primary acoustic signals (from loudspeakers 163 and 165) and a plurality of secondary acoustic signals (from loudspeakers 167) of individually selectable intensities which correspond to a mix of the primary acoustic signals delayed and displaced in azimuth relative to the primary acoustic signals. The delay constants for the respective secondary acoustic signals are individually selectable from a range of values which are large compared with the time taken for sound to traverse the listening area 161.

I claim:

1. A sound reproduction arrangement comprising:

(a) a listening area;

(b) at least a first primary loudspeaker located in said listening area and connected to be driven in response to a first audio frequency signal;

(c) input means responsive to said first audio frequency signal to provide input signal data as a function thereof;

(d) signal delay means connected to receive said input signal data and provide a plurality of delayed signals each corresponding to the said input signal data delayed by a respective delay constant, said delay means including means conditioned and arranged to multiply each of the said delayed signals by a respective pre-selected gain constant, a plurality of output channels each supplied with at least a respective one of said delayed signals, addressable data storage means for storing successive sampled values of the said input signal data, control means arranged for response to a periodic clock signal to supply a preselected sequence of address instructions to said data storage means so as to produce successive cycles of record/recall operations in each of which at least a respective one of the said successive sampled values is recorded, and a plurality of stored sampled values which sampled values have each been recorded a respective pre-selected numbers of cycles previously, are recalled sequentially, and a demultiplexer means connected for response to the data output by said data storage means and arranged to assign the recalled values to respectively pre-selected ones of said output channels, whereby in use the said data output by said data storage means comprises a plurality of time division multiplexed components each associated with a respective one of the said pre-selected numbers, the said delayed signals being formed by respective ones of the said components and the said delay constants being related, respectively, with associated ones of said pre-selected numbers; and (e) a plurality of secondary loudspeakers disposed at respective locations spaced around the perimeter of said listening area and each connected to be driven by a respective one of said output channels, the delay constant and secondary loudspeaker for each of said delayed signals being selected so that the delay and direction of the sound produced in the listening area in response thereto substantially corresponds to those of a sound corresponding to said first audio frequency signal reflected from the boundary of an enclosure of substantially greater size than that of the listening area, thus obtaining a sensation of spaciousness.

2. An arrangement as claimed in claim 1, for stereo reproduction, the arrangement comprising a second primary loudspeaker located in said listening area and connected to be driven in response to a second audio frequency signal, wherein said input means is arranged for response to said first and second audio frequency signals to provide said input signal data as a function of both said first and second audio frequency signals.

3. An arrangement as claimed in claim 1, wherein said addressable data storage means is a digital data storage means for storing the said sampled values in digital code.

4. An arrangement as claimed in claim 3, comprising digital-to-analog conversion means connected to convert the said data output by said storage means to analog form for supply to said demultiplexer means, whereby said demultiplexer means assigns an analog representation of the said recalled values to the said preselectable output channels.

5. An arrangement as claimed in claim 3, wherein said input signal data is provided in analog form and said signal delay means comprises sampling means for periodically sampling said input signal data and analog-to-digital conversion means for converting the sampled values of said input signal data to digital code whereby to provide the said successive sampled values.

6. An arrangement as claimed in claim 3, wherein said addressable data storage means comprises a random access memory.

7. An arrangement as claimed in claim 1, wherein said addressable data storage means includes (a) random access data storage means whereby in use the data output from said storage means comprises the successive sampled values of the input signal data delayed by a period related to that number, and the delayed signals thus formed by said components are supplied to said corresponding output channels.

8. Apparatus as claimed in claim 7, wherein said random access data storage means is a digital data storage means for storing the said successive sampled values in digital code, the apparatus further comprising digital-to-analog conversion means connected to convert the said delayed signals formed by said components to corresponding analog signals.

9. Apparatus as claimed in claim 8, wherein said digital-to-analog conversion means is connected to convert the said recalled values to analog form before supply to said demultiplexer means.

10. Apparatus as claimed in claim 8, further comprising input means arranged for receiving the said input data in analog form and comprising sampling means for deriving the said successive sampled values of the input data and analog-to-digital converter means for converting said sampled values to digital form for supply to said data storage means.

11. Apparatus as claimed in claim 7, wherein said random access data storage means is an analog data storage means for storing the successive sampled values of said input data in analog form.

12. Apparatus as claimed in claim 7, wherein said control means comprises shift register means for storing a plurality of address words representing respective data storage locations in said data storage means, the shift register means being responsive to the said periodic clock signal to recirculate the said address words therethrough on each of said cycles for sequential supply to the address input of said data storage means, and up-date means connected with said shift register means to up-date each of said stored address words by a fixed increment on each of said cycles.

13. Apparatus as claimed in claim 7, wherein said control means comprises a time slot counter connected to be clocked in response to said periodic clock signal and record/recall control means connected with said time slot counter to enable recording in said data storage means of said sampled values in response to at least one value of the count in said time slot counter and to enable recall of said stored values in response to any of a plurality of counts in said time slot counter.

14. Apparatus as claimed in claim 13, wherein said control means comprises arithmetic means including first and second inputs and an output, addressable offset data storage means for storing at respective addressable locations therein a plurality of offset data words representing respective delay constants, and a base address counter connected with said time slot counter so as to be clocked on each occurence of said at least one value of the count therein, wherein said time slot counter is connected with the address input of said offset data storage means so that said offset data words are recalled sequentially therefrom in response to said periodic clock signal, said first and second inputs of said arthmetic means are connected with the data output of said offset data storage means and with said base address counter respectively to provide at said output of said arithmetic means a sequence of address words formed respectively by the sums of the count in said base address counter and said sequentially recalled offset data words, said sequence of address words being supplied to the address input of said data storage means.

* * * * *